United States Patent [19]

Himmelrich

[11] 4,103,758

[45] Aug. 1, 1978

[54] SAFETY/TOOL BELT COMBINATION

[76] Inventor: Lew Himmelrich, P.O. Box 777, San Juan Capistrano, Calif. 92675

[21] Appl. No.: 773,956

[22] Filed: Mar. 3, 1977

[51] Int. Cl.[2] ..... A62B 35/00

[52] U.S. Cl. ..... 182/3; 182/7; 224/5 B; 224/5 BC

[58] Field of Search ..... 182/3–9; 119/96; 224/26 B, 5 BC, 5 B

[56] References Cited

U.S. PATENT DOCUMENTS

| | | | |
|---|---|---|---|
| 2,833,454 | 5/1958 | McGee | 182/3 |
| 3,099,331 | 7/1963 | Rose | 182/3 |
| 3,212,690 | 10/1965 | Green | 182/3 |

*Primary Examiner*—Reinaldo P. Machado

*Attorney, Agent, or Firm*—Wills, Green & Mueth Law Corporation

[57] ABSTRACT

A belt assembly capable of functioning as both a safety belt and a support for a tool carrier, and which includes a first belt adapted to extend about the back of a user's waist and carrying two connecting rings at opposite sides of the user's body, and a second belt which also extends across the back of the user's waist and is attached to the first belt at a predetermined location but not at a second location at which the belts are separable to allow a tool carrier to be slipped onto and be suspended by that portion of the second belt. The first belt is preferably shaped to have two portions one of which is received behind and supports the user's waist, and the other of which can extend downwardly between the rings to support the user's body in a sitting position.

11 Claims, 7 Drawing Figures

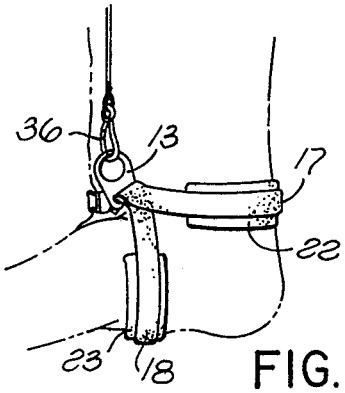
FIG. 1
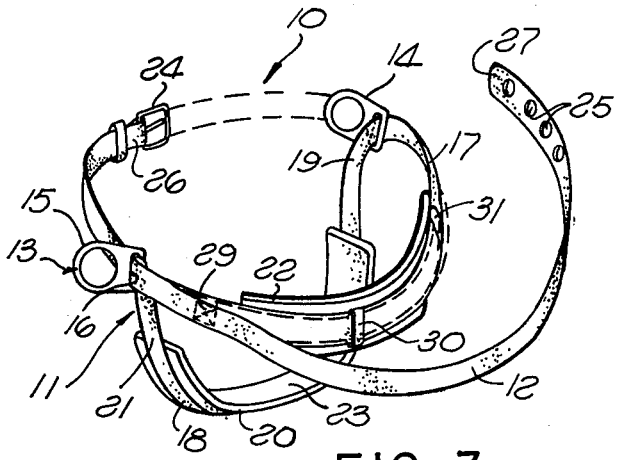
FIG. 3
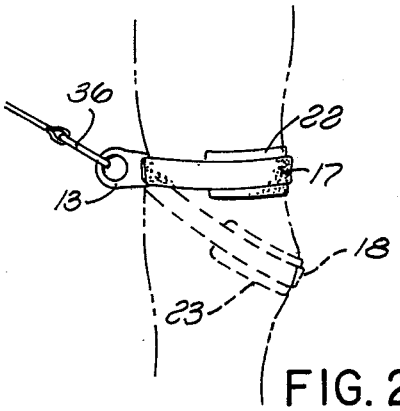
FIG. 2
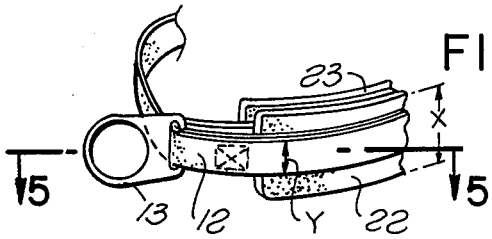
FIG. 4
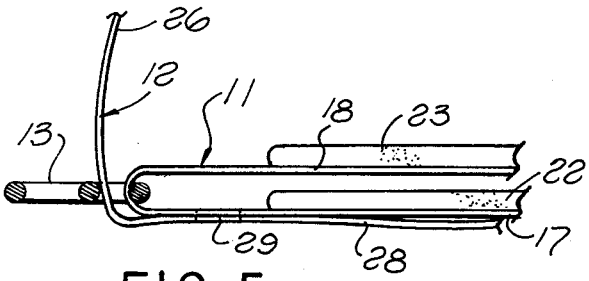
FIG. 5
FIG. 6
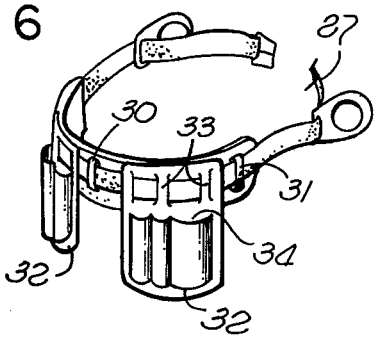
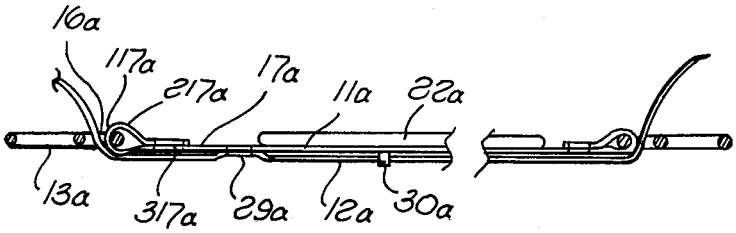
FIG. 7

SAFETY/TOOL BELT COMBINATION

BACKGROUND OF THE INVENTION

This invention relates to improved safety belts to be worn by persons working at an elevated location for attaching the person to a support structure in a relation preventing him from falling.

Conventional safety belts are provided with one or more rings to which a safety lanyard, chain, or the like, can be connected to secure the belt through the ring and lanyard to a support structure. In many cases, at least two such connector rings are required, with these rings being connected to the belt at opposite sides of the workman's body. One problem which has been encountered in the past when two such rings are provided on a safety belt resides in the difficulty which is encountered in attempting to attach a tool carrier to the belt. Attachment of the connector rings to opposite sides of the belt prevents a user from slipping a tool carrier onto the belt from either of its sides, and thus may require use of a second separate belt merely for carrying the tool pouch. This duplication of belts may be very inconvenient and uncomfortable, and is an arrangement disliked by most workmen.

SUMMARY OF THE INVENTION

The present invention provides a new type of belt assembly which is especially designed to more effectively serve the dual purposes of safety belt and tool carrier in a single easily handled and very conveniently and comfortably worn unit. A standard tool carrier may be very easily connected to a belt assembly embodying the invention, but when attached is retained very positively and effectively without danger of separation from the belt in use. Also, the assembly can be adapted to provide a pad or pads for spreading the force which is applied to the belt by a user's body, and can afford support against both rearward and downward movements of the user's body.

An assembly constructed in accordance with the invention preferably includes a first belt which extends across the back side of the user's waist and carriers a pair of connector rings at opposite sides of the user's body, in combination with a second belt which is secured to the first belt at a predetermined attachment location but which has a portion extending beyond that attachment location but between the two rings and which is free of direct attachment to the adjacent portion of the first belt in a relation enabling a tool carrier to be slipped onto and be carried by that portion of the second belt between the rings. Buckle means at the front of the assembly secure opposite ends of one of the belts (preferably the second belt) together to retain the assembly about the user's waist. The point of attachment of the belts is desirably near one side of the user's body, and behind one of the rings, with the remainder of the second belt being unattached to the first except temporarily by extension through loops carried by the corresponding portion of the first belt.

A presently preferred assembly embodying the invention includes a first belt which is connected at spaced locations to the two rings and has a rear portion extending between the rings and across the back side of these user's waist, and a second portion extending downwardly from the rings to support the user's body in a sitting position. The rings may be slidably received on this belt to enable shifting movement of the rings in a manner varying the relative lengths of the rear and seat portions of the belt. A second belt associated with the first belt extends entirely about the user's body and is buckled at its forward end to retain the assembly on the user, but as discussed previously has a portion which is not directly attached the adjacent portion of the first belt to enable attachment of a tool holder. The second belt may be stitched or otherwise permanently attached to the first mentioned portion of the first belt, at a location behind one of the rings, but in a manner leaving the rest of the second belt free of direct attachment to the adjacent portion of the first belt.

BRIEF DESCRIPTION OF THE DRAWING

The above and other features and objects of the invention will be better understood from the following detailed description of the typical embodiments illustrated in the accompanying drawing in which:

FIG. 1 is a side view of a first form of safety belt assembly constructed in accordance with the invention, and shown as it appears when supporting a workman in a sitting position;

FIG. 2 is a side view similar to FIG. 1, but showing in full lines the appearance of the belt assembly when it is adjusted to support only the back side of the user's waist, and showing an intermediate position in broken lines;

FIG. 3 is an enlarged perspective view showing the belt assembly with the seat portion of the belt extending downwardly;

FIG. 4 is a fragmentary perspective representation of the assembly in its FIG. 2 condition;

FIG. 5 is an enlarged horizontal section taken on line 5—5 of FIG. 4;

FIG. 6 is a fragmentary perspective view showing the device when a tool carrier is attached thereto; and FIG. 7 is a view similar to FIG. 5, but showing a variational arrangement.

DESCRIPTION OF THE PREFERRED EMBODIMENTS

Referring first to FIG. 3, the safety belt assembly 10 shown in the figure includes two flexible high strength belts 11 and 12, both typically formed of nylon webbing, such as for example that defined in military specification MIL-W-4088E. Two "D" rings 13 and 14 are connected to these belts at locations to be received at opposite sides of the user's body, with each of these rings being formed of metal forged to provide a main essentially circular connecting loop 15 and an elongated straight slit 16 inwardly of the loop for slidably receiving the belts.

The belt 11 may be formed as an endless strip of the nylon webbing having a first length 17 which extends between the two rings 13 and 14 and across the back side of the user's waist, and having a second length 18 which extends downwardly from one of the rings at 19, then generally horizontally at 20 across the underside of the user's body when in a sitting position, and then upwardly again at 21 to the second of the metal rings. At the juncture of portions 17 and 18, belt 11 extends through the two slits 16 in the metal rings, with the rings being slidable along the belt to increase the length of portion 17 and correspondingly decrease the length of portion 18, or vice versa, as desired to fit a particular workman in a particular position. As will be understood, belt 11 is of uniform width and construction along its entire length, with the rings 13 and 14 tending to automatically assume a properly inclined position for enabling the two portions 17 and 18 to extend at an angle to one another as shown.

The upper portion 17 of belt 11 carries a pad 22 at its forward side having a vertical dimension *x* greater than the width *y* of the belt itself. For example, pad 22 may have a vertical width of 3 inches or 4 inches, while the nylon webbing of belt 11 itself may have a width *y* of 1 ¾ inches. The pad 22 is formed of a relatively soft material which is sewed to portion 17 of belt 11, and acts to spread the force exerted by a user's body against belt portion 17 over a wider area than that of the belt itself. Similarly, the lower seat portion 18 of belt 11 carries a pad 23, which may be constructed the same as pad 22 and in the FIG. 3. condition is received at the upper side of portion 18 to spread force exerted by the user's body against an increased area as compared with that of the belt.

The second belt 12 is of a length to extend entirely about the user's body, and has a buckle 24 at one of its ends and spaced grommets or openings 25 formed in its opposite end for coaction with the buckle in adjustably connecting the opposite ends 26 and 27 of belt 12 together to retain the assembly about a user's waist. As will be understood, the ends 26 and 27 of belt 12 are received at the front of the user's body, between the two rings 13 and 14. In extending rearwardly from the buckle end 26, belt 12 passes through slit 16 of ring 13 at the outer side of belt 11 (see FIG. 5), and then extends rearwardly at 28 along the back side of portion 17 of belt 11 to the location of the second ring 14, at which belt 12 passes through the slit 16 in that ring, again at the outer side the belt 11, and can then extend forwardly for connection to the buckle.

The two belts 11 and 12 are preferably connected together at only one location, specifically at the point designated by the number 29 in FIG. 3. This attachment location is desirably at one side of the user's body, near the location of and just behind one of the rings 13. The connection at the point 29 may be made by stitching the two belts together at that point, to form a connection strong enough to hold the belts in assembled condition at all times, during handling and during attachment of the belt to and removal of the belt from a person's body. Between the attachment location 29 and the end 27 of belt 12, this belt is free of any permanent direct attachment to the adjacent portion of belt 11, but may be retained in proper position of extension along portion 17 of belt 11 by provision of two loops 30 and 31 connected permanently to portion 17 of belt 11 and forming guideways through which belt 12 can be passed. The loop 30 may be located at essentially the center of the user's back, midway between the two rings 13 and 14, while the second loop 31 may be located closely adjacent ring 14.

When it is desired to attach one or more tool carriers 32 (FIG. 6) to the belt assembly of FIGS. 1 to 6, the end 27 of belt 12 may be pulled out of its position of reception within the slit 16 of ring 14, and be pulled out of its position of extension through loops 30 and 31, and to the position represented in full lines in FIG. 3. In this condition, one of the tool carriers 32 may be slipped onto belt 12 past its end 27, following which the belt end 27 may be passed through the first loop 30 to be retained thereby, so that a next successive tool holder 32 can be slipped onto belt 12 past its end 27, and that end may then be threaded through loop 31 and into and through the slit 16 of ring 14 to the position represented in broken lines in FIG. 3. In that condition, the ends 26 and 27 of belt 12 can be connected together to secure the assembly about the user's waist. It will of course be understood that the holders are of any conventional construction, having loops or straps 33 near their upper ends through which the belt can extend in suspending relation, and having pockets 34 for receiving tools or other items used in the work being performed by the person wearing the belt.

If the worker is to be suspended in a sitting position, the portion 18 of the strap is swung downwardly to the condition illustrated in FIGS. 1 and 3, so that two cables or other supporting elememts 36 connected to rings 13 and 14 can suspend the belt assembly and the worker in a manner illustrated in FIG. 1. If the worker is to be in a standing position, portion 18 is swung upwardly to the condition illustrated in FIGS. 2, 4, and 5, in which portion 18 and its carried pad 23 are received directly in front of belt portion 17 and pad 22, so that both act together to support the back side of the user's waist. In any intermediate position such as that shown in broken lines in FIG. 2, the portion 18 and its pad 23 can support the user's body in a partially sitting or leaning position.

FIG. 7 shows a variational arrangement which is similar to that of FIGS. 1 to 6 except that the seat portion 18 of belt 11 has been omitted. In FIG. 7, the belt **12*a* may be identical with belt 12 of the first form of the invention, and the portion 17*a* of belt 11*a* may be identical with portion 17 of belt 11 of the first form of the invention, except that portion 17 is not slidable relative to ring 13*a* or 14*a*, but rather is permanently attached in fixed relation to these rings by extension at 117*a* through slit 16*a* of the ring and then being doubled back at 217*a* and stitched to itself at 317*a*. The pad 22*a* may be the same as pad 22 of FIGS. 1 to 6, and serve the same purpose. As in the first form of the invention, the two belts 11*a* and 12*a* are secured together at only a localized single area 29*a*, corresponding to that shown at 29 in FIG. 3, with belt 12*a* being free of direct attachment beyond that point but adapted to pass through a loop 30*a* (corresponding to loop 30) carried by belt 11*a*, and then extend through the slit 16 of the opposite ring, all in a manner enabling removable retention of tool carriers as represented at 32 in FIG. 6**.

While certain specific embodiments of the present invention have been disclosed as typical, the invention is of course not limited to these particular forms, but rather is applicable broadly to all such variations as fall within the scope of the appended claims.

I claim:

1. A safety belt assembly comprising:

two connecting rings to be received near opposite sides respectively of a user's body;

a first belt connected at spaced locations to said two rings respectively in a relation forming a rear portion of the first belt adapted to extend across the back of a user's waist between said rings, and forming a seat portion of the first belt which can extend downwardly between the two rings to support the user in essentially a sitting position;

a second belt to extend about the back of the user's waist adjacent said first belt and between said rings; and buckle means for releasably securing opposite ends of said second belt together to retain said assembly about a user's waist;

said second belt having a portion which is received essentially adjacent said first belt between said rings and toward the back of the user's waist when the assembly is in use, but which is free of direct attachment to the adjacent portion of said first belt in a relation enabling a tool carrier to be slipped onto and be carried by said portion of the second belt between said rings; and said rings containing slits slidably receiving said first belt to enable adjustment of the rings along said first belt and consequent adjustment of the relative lengths of said rear portion and seat portion thereof.

2. A safety belt assembly as recited in claim 1, including two pads carried by said rear portion and said seat portion respectively of said first belt and each having a width greater than that of the first belt to spread the force applied thereto.

3. A safety belt assembly as recited in claim 1, including means fixedly attaching said second belt to said first belt at a predetermined localized attachment location, while leaving beyond that attachment location said portion of the second belt which is free of direct attachment to the first belt at a location between said rings for reception of said tool carrier.

4. A safety belt assembly as recited in claim 1, including stitching securing said second belt to said first belt at a predetermined localized attachment location near but rearwardly of one of said rings, while leaving the remaining portions of said second belt free of direct attachment to the first belt.

5. A safety belt assembly as recited in claim 1, in which said second belt has opposite end portions extending forwardly beyond the locations of said rings and detachably connectable together by said buckle means.

6. A safety belt as recited in claim 1, in which said second belt extends through said slits in said rings.

7. A safety belt assembly as recited in claim 1, including means attaching said belts together at essentially one side of the user's body, while leaving said belts free of direct attachment to one another essentially entirely across the back of the user's waist to the opposite side of his body.

8. A safety belt assembly as recited in claim 1, including a tool carrier having a portion removably received about said portion of the second belt at the back of the user's waist.

9. A safety belt assembly comprising:

two connecting rings to be received near opposite sides respectively of a user's body;

a first belt connected at spaced locations to said two rings respectively in a relation forming a rear portion of the first belt adapted to extend across the back of a user's waist between said rings, and forming a seat portion of the first belt which can extend downwardly between the two rings to support the user in essentially a sitting position;

a second belt to extend about the back of the user's waist adjacent said first belt and between said rings;

buckle means for releasably securing opposite ends of said second belt together to retain said assembly about a user's waist;

said second belt having a portion which is received essentially adjacent said first belt between said rings and toward the back of the user's waist when the assembly is in use, but which is free of direct attachment to the adjacent portion of said first belt in a relation enabling a tool carrier to be slipped onto and be carried by said portion of the second belt between said rings; and said connecting rings being slidable along said second belt to vary the relative lengths of said rear and seat portions thereof, and in a relation enabling said seat portion to be shifted upwardly to a position directly in front of and adjacent said rear portion for assisting in supporting the back of the user's waist.

10. A safety belt assembly comprising:

two connecting rings to be received near opposite sides respectively of a user's body;

a first belt connected at spaced locations to said two rings respectively in a relation forming a rear portion of the first belt adapted to extend across the back of a user's waist between said rings, and forming a seat portion of the first belt which can extend downwardly between the two rings to support the user in essentially a sitting position;

a second belt to extend about the back of the user's waist adjacent said first belt and between said rings;

buckle means for releasably securing opposite ends of said second belt together to retain said assembly about a user's waist;

said second belt having a portion which is received essentially adjacent said first belt between said rings and toward the back of the user's waist when the assembly is in use, but which is free of direct attachment to the adjacent portion of said first belt in a relation enabling a tool carrier to be slipped onto and be carried by said portion of the second belt between said rings;

said rings having loop portions for connection to coacting retaining parts, and containing slits slidably receiving both of said belts in a relation enabling said seat portion of the first belt to be swung upwardly from a sitting position to an upper position adjacent and in front of said rear portion of the belt or to intermediate positions between said sitting and upper positions;

said assembly including pads wider than said first belt and secured to said rear portion and said seat portion respectively thereof to spread forces applied to the first belt;

means permanently attaching said second belt to said first belt at a predetermined localized attachment location near one side of the user's body and behind one of said rings, but leaving the remainder of said second belt free of direct permanent attachment to said first belt across the back of the user's waist and to an end of the second belt to enable reception of a tool carrier about the second belt at the back of the user's waist; and at least one loop carried by said rear portion of said first belt and removably receiving said second belt in locating relation.

11. A safety belt assembly comprising:

two connecting rings to be received near opposite sides respectively of a user's body;

a first belt connected at spaced locations to said two rings respectively in a relation forming a rear portion of the first belt adapted to extend across the back of a user's waist between said rings, and forming a seat portion of the first belt which can extend downwardly between the two rings to support the user in essentially a sitting position;

a second belt to extend about the back of the user's waist adjacent said first belt and between said rings;

buckle means for releasably securing opposite ends of said second belt together to retain said assembly about a user's waist;

said second belt having a portion which is received essentially adjacent said first belt between said rings and toward the back of the user's waist when the assembly is in use, but which is free of direct attachment to the adjacent portion of said first belt in a relation enabling a tool carrier to be slipped onto and be carried by said portion of the second belt between said rings; and said rings slidably receiving said first belt to enable adjustment of the rings along said first belt and consequent adjustment of the relative lengths of said rear portion and seat portion thereof.

* * * * *